United States Patent [19]

Kishi et al.

[11] 4,293,749

[45] Oct. 6, 1981

[54] PUFFER TYPE GAS CIRCUIT BREAKER

[75] Inventors: Tuneo Kishi; Koji Sasaki, both of Hitachi, Japan

[73] Assignee: Hitachi, Ltd., Tokyo, Japan

[21] Appl. No.: 60,480

[22] Filed: Jul. 25, 1979

[30] Foreign Application Priority Data

Jul. 26, 1978 [JP] Japan ..... 53/90439

[51] Int. Cl.[3] ..... H01H 33/16

[52] U.S. Cl. ..... 200/144 AP; 200/148 A

[58] Field of Search ..... 200/144 AP, 148 A

[56] References Cited

U.S. PATENT DOCUMENTS 3,745,284 7/1973 Hosokawa ..... 200/144 AP 4,009,458 2/1977 Kishi et al. ..... 200/144 AP

FOREIGN PATENT DOCUMENTS 430452 6/1935 United Kingdom ..... 200/144 AP

*Primary Examiner*—Robert S. Macon

*Attorney, Agent, or Firm*—Craig and Antonelli

[57] ABSTRACT

A puffer type gas circuit breaker comprising at least a pair of main movable and fixed contacts, a puffer device and a pair of preinsertion resistor contacts inserted in parallel with the main movable and fixed contacts, wherein the main movable resistor contact is mounted through a plurality of adjustment plates to a support arm mounted on the puffer device.

5 Claims, 3 Drawing Figures

PUFFER TYPE GAS CIRCUIT BREAKER

This invention relates to a puffer type gas circuit breaker, and in particular to a puffer type gas circuit breaker with a preinsertion resistor contact unit.

The preinsertion resistor contact unit is used for restricting the surge voltage occurring at the time an interrupting unit is closed. The preinsertion resistor contact unit, which comprises a preinsertion resistor assembly and resistor contact, is electrically connected in parallel with an interrupting unit. The resistor contact are adapted to be closed so as to insert the preinsertion resistor in a circuit before the interrupting unit is closed, and the resistor contacts are opened before the interrupting unit is opened.

In a well-known puffer type gas circuit breaker having such a preinsertion resistor contact unit, a single operating means is provided to simultaneously operate both the movable resistor contact of the preinsertion resistor contact unit and the main movable contact of the movable resistor contact. Such construction is described in Japanese Layed-open Utility Model Application No. 53-8577 entitled "CIRCUIT BREAKER". In this publication, the movable resistor contact of the preinsertion resistor contact unit is fixed to the puffer cylinder of the interrupting unit. As a result, it has been very difficult to perform a "touch adjustment" between the resistor contacts of the preinsertion resistor contact unit and the main contacts of the interrupting unit. The "Touch adjustment" means to adjust to a constant value the time interval between the close operation of the main fixed contact and main movable contact of the interrupting unit and the close operation of the fixed resistance contact and movable contact of the preinsertion contact unit, or the time interval between the open operation of the main fixed contact and main movable contact of the interrupting circuit and the open operation of the fixed resistor contact and movable resistor contact. If the touch adjustment has not properly performed between phases of the puffer type gas circuit breaker, the associated power distribution lines are adversely affected for a stable operation when the puffer type gas circuit breaker is opened or closed.

In the above example, the movable resistor contact of the preinsertion resistor contact unit is fixed to the puffer cylinder of the interrupting unit as described above, so that the touch adjustment for the resistor contacts of the preinsertion resistor contact unit must be performed on the side of the fixed resistor contact of the preinsertion resistor contact unit. In order to perform the touch adjustment, it is necessary to remove the long fixed resistor contact from the interrupting unit and to insert a liner having suitable thickness between an insulator and the insertion resistor contact. Such works are very difficult and elaborate to perform the touch adjustment in the conventional puffer type gas circuit breaker.

It is an object of the invention to prevent a production of unbalanced current components in phases at the time that a puffer type gas circuit breaker is opened or closed.

It is another object of the invention to provide a puffer type gas circuit breaker which can easily achieve a touch adjustment.

It is still another object of the invention to provide a puffer type gas circuit breaker of rigid structure in which a touch adjustment can be easily achieved and improved in dielectric strength.

It is still another object of the invention to facilitate maintenance and repairing of an interrupting unit.

It is still another object of the invention to provide a puffer type gas circuit breaker which can be housed in a relatively small sealed container.

It is still another object of the invention to provide an optimum controlling of the flow of arc-affecting gas when a puffer type gas circuit breaker is opened.

According to the present invention, a puffer cylinder of an interrupting unit is connected to a support arm which is connected to a movable resistor contact through a plurality of adjustment plates used for the touch adjustment. Therefore, the touch adjustment for preinsertion resistor contacts can be easily performed by selecting a proper number of such adjustment plates having light weight. By the provision of the support arm, the movable resistor contact of the preinsertion resistor contact unit can be located apart from the outside of the interrupting unit, so that it is easy to electrically insulate the interrupting unit from the movable resistor contact.

The invention will be further described with reference to accompanying drawings in which:

FIG. 1 shows an arrangement of a dead tank type puffer gas circuit breaker with two interrupter units. In FIG. 1 the details of a preinsertion resistor contact and an operating linkage are not shown, but they will be described in detail with reference to FIG. 2.

Figure 1:
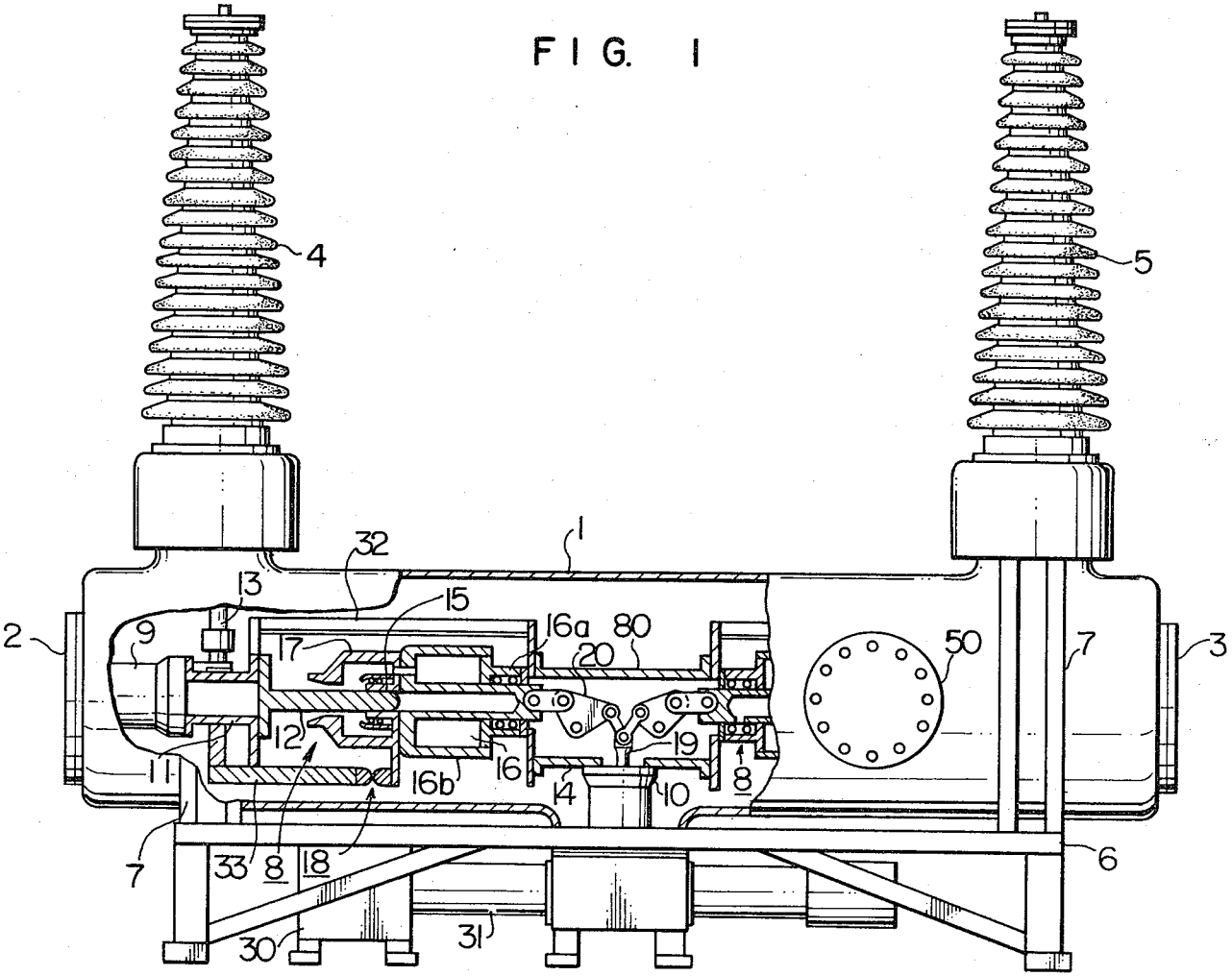
FIG. 1 shows a side view, partly broken of one embodiment of a puffer type gas circuit breaker in accordance with the present invention.

Referring to FIG. 1, a metal tank 1 has its opened ends hermetically sealed with end plates 2 and 3, and is filled with an arc suppressing or extinguishing gas, such as $SF_6$. Two terminal bushings 4 and 5, which are spaced apart from each other by a suitable distance are attached to the top side of the metal tank 1 and supported by a supporting framework 6 through ribs 7. Two interrupter units each generally designated by 8 are inclosed in the metal tank 1, and each of them is interposed between and supported by an insulating supporting cylinder 9 securely attached to the inner wall of a respective one of the end plates 2 or 3 and a central insulating supporting cylinder 10 located substantially at the midpoint between the axial length of the metal tank 1. More particularly, the insulating supporting cylinder 9 is connected to a fixed main contact 12 of the interrupter unit 8 through a supporting conductor 11 which is a main circuit conductor and is connected to a central conductor 13 extending through the terminal bushing 4 or 5. A central bracket 14 which is attached to the central insulating supporting cylinder 10 is electrically connected to a movable main contact unit generally indicated by 15. The two interrupter units 8 are electrically interconnected each other through a connecting conductor 80 mounted on the central bracket 14.

A puffer device generally indicated by 16 and comprised of a puffer piston **16*a* and a puffer cylinder 16*b* for compressing the arc suppressing or extinguishing gas is assembled with the movable main contact unit 15**.

In the instant embodiment, the puffer piston 16*a* is attached to the central bracket 14 while the puffer cylinder 16*b* is movable as will be described hereinafter. An insulating nozzle 17 is attached to the puffer cylinder 16*b* to enclose therein a main movable contact unit 15 so that the arc-suppressing or extinguishing gas compressed by the puffer device may be directed to the portion where the fixed and movable main contacts 12 and 15 contact with each other or separate from each other. Both the movable main contact unit 15 and the puffer device are operatively connected to a control mechanism (not shown) enclosed in a control chamber 30 through a operating linkage 20 which is operatively coupled to an insulating rod 19 which is extended through the central supporting cylinder 10 and is coupled to a connecting lever (not shown) extending through a cylinder 31 interposed between the central supporting cylinder 10 and the control cabinet 30.

In order to equally divide the voltage imposed on the interrupter units 8, a voltage dividing capacitor 32 and a preinsertion resistor contact unit 18 are interposed in parallel between the fixed main contact 12 of the interrupter unit 8 and its corresponding movable contact unit 15. The preinsertion resistor contact unit 18 is actuated by a operating linkage generally indicated by 20 as will be described in detail hereinafter.

Next referring to FIG. 2 the constructions of the interrupter unit 8, preinsertion resistor contact unit 18 and the operating linkage 20 will be described in detail.

As described above, the insulating supporting cylinder 9 is provided in the metal tank 1 filled with arc suppressing or extinguishing gas and the cylinder 9 is fixed to the end plate 2 or 3 on the metal tank 1. However, the insulating supporting cylinder 9 may be replaced by insulating spacers as shown in Japanese Patent Publication No. 53-21094 "Gas-insulated Circuit Breaker" which discloses a puffer type gas circuit breaker/disconnector including insulator spacers between sealed housings for the circuit breaker and the disconnector.

The insulating supporting cylinder 9 cooperates with a supporting conductor 11 to fixedly mount a supporting conductor 90. The supporting conductor 90 mounts a shield 91 enclosing the main fixed contact 12. The main movable contact 15 opposed to the main fixed contact 12 is mounted on a puffer cylinder 16*b*. The puffer cylinder 16*b* is supported by a puffer piston 16*a* fixed to a central bracket 14. An insulating nozzle 17 enclosing the main movable contact 15 is fixed to the puffer cylinder 16*b* by a fixture 92.

The puffer cylinder 16*b* and the puffer piston 16*a* form a compressor means for compressing the $SF_6$ gas in the metal tank 1 in accordance with the movement of the main movable contact 15 leaving the main fixed contact 12. The compressed $SF_6$ gas is introduced to an opening 93 provided in the puffer cylinder 16*b* and applied through the insulating nozzle 17 to arc between the main contacts 12 and 15. The main movable contact 15, the puffer cylinder 16*b* and the insulating nozzle 17 form a movable portion of the interrupting unit. A preinsertion resistor contact unit is electrically connected in parallel with the interrupting unit. The preinsertion resistor contact unit will be described below.

A support arm 32 integrally formed with the fixture 92 extends in a direction perpendicular to the axis of the puffer cylinder 16*b* and has its free end connected to a movable resistor contact 33. Alternatively, the support arm 32 may be formed separately from the fixture 92 and fixed to the puffer cylinder 16*b*. The movable resistor contact 33 is fixed to the support arm 32 by means of a nut 34 engaged with a threaded portion of the movable resistor contact 33 so as to fix a desired pieces of adjustment plates 94 between the movable contact 33 and the support arm 32. The position of the movable resistor contact 33 can be changed by changing the number of adjustment plates. A shield 36 is supported between the adjustment plates 94 and the movable resistor contact 33. The shield 36 may be fixed directly to the support arm 32. In the preferred embodiment, the shield 36 is provided to enclose the movable resistor contact 33, the adjustment plates 94 and the portion of the support arm 32. Therefore, the electric field intensities between the movable resistor contact 33 and the metal tank 1 and between the movable resistor contact 33 and the fixed resistor contact 57 are maintained constant regardless of the number of adjustment plates 94, and this constantly gives a stable insulation characteristic.

The supporting conductor 90 fixedly carries a fixture 61 which is connected to an insulating arm 37. The insulating arm 37 supports a central portion of a preinsertion resistor assembly 118. The preinsertion resistor assembly 118 comprises an insulating cylinder 39, a plurality of ring-shaped resistor elements 50 within the cylinder 39, and an insulating rod 51 penetrating through the ring-shaped resistor elements 50. The preinsertion resistor assembly 118 is electrically and mechanically connected at its right end to the supporting conductor 90 fixedly by a fixture 62. A threaded ring 95 is provided on the insulating rod 51 penetrating through the resistor elements 50. The threaded ring 95 is engages with a pair of conductor plates 52*a* and 52*b* between which an insulating arm 37 is fixedly mounted. More specifically, the preinsertion resistor assembly 118 is formed integrally with the insulating arm 37 in the following manner. First, a plurality of resistor elements 50 and the ring 95 are penetrated by the insulating rod 51, the conductor plate 52*a* is engaged with the ring 95, then the insulating arm 37 is inserted, and finally the conductor plate 52*b* is engaged with the ring 95.

The insulating rod 51 is engaged at its left end with an internally threaded end fixture 53. In order to apply contact pressure between resistor elements 50, a spring 54 is provided between the end fixture 53 and an end plate 55. The end plate 55 fixedly mounts a dash-pot cylinder 56 in which a main fixed contact 57 is slidably disposed. The main fixed contact 57 is constantly biased toward the left by a spring 58 provided between the main fixed contact 57 and the end fixture 53. The main fixed contact 57 is connected to the supporting conductor 90 through the resistor elements 50 and the fixture 62.

An adequate distance is required between the fixed resistor contact 57 and the shield 91 because a voltage corresponding to the impedance of the resistor elements 50 is applied therebetween while the resistor contacts 33 and 57 are in contact with each other. However, such an adequate distance between the fixed resistor contact 57 and the shield 91 for the main fixed contact 12 is steadily provided as the movable resistor contact 33 is disposed in a lower position by the support arm 32. In addition, the insulating arm 37 is fixed to the end fixture 53 indirectly and through resistor elements 50 and accordingly the insulating arm 37 may have only a dielectric strength corresponding to the voltage applied across the resistor elements 50 located between the fixture 62 and the insulating arm 37. As a result, according to the present invention, the support arm 32 and the insulating arm 37 may be made shorter for an adequate dielectric strength, compared with the prior art breaker in which the insulating arm 37 is fixed directly to the end fixture 53. In the preferred embodiment of the invention, the insulating arm 37 is provided in a position distant from the end fixture 53 side by at least two pieces of resistor elements 50, so that the interrupting unit and the preinsertion resistor contact unit can be properly positioned in the respect of electric field.

A shield 70 is also provided to weaken the electric field strength of the main movable contact 15, puffer device 16 and movable resistor contact 33 are subjected.

The operating linkage 20 comprises a triangle lever 22 which is pivoted to the central bracket 14 with a pivot pin 21 at its first vertex, a link 25 whose on end is pivoted with a pin 24 to the upper end of the operating rod 19 and whose other end is pivoted with a pin 23 to a second vertex of the lever 22, and another link 29 whose one end is pivoted to a third vertex of the lever 22 with a pin 26 and whose other end is pivoted with a pin 28 to a puffer shafts 27 formed integrally with and extended from the puffer cylinder 16*b*.

Figure 2:
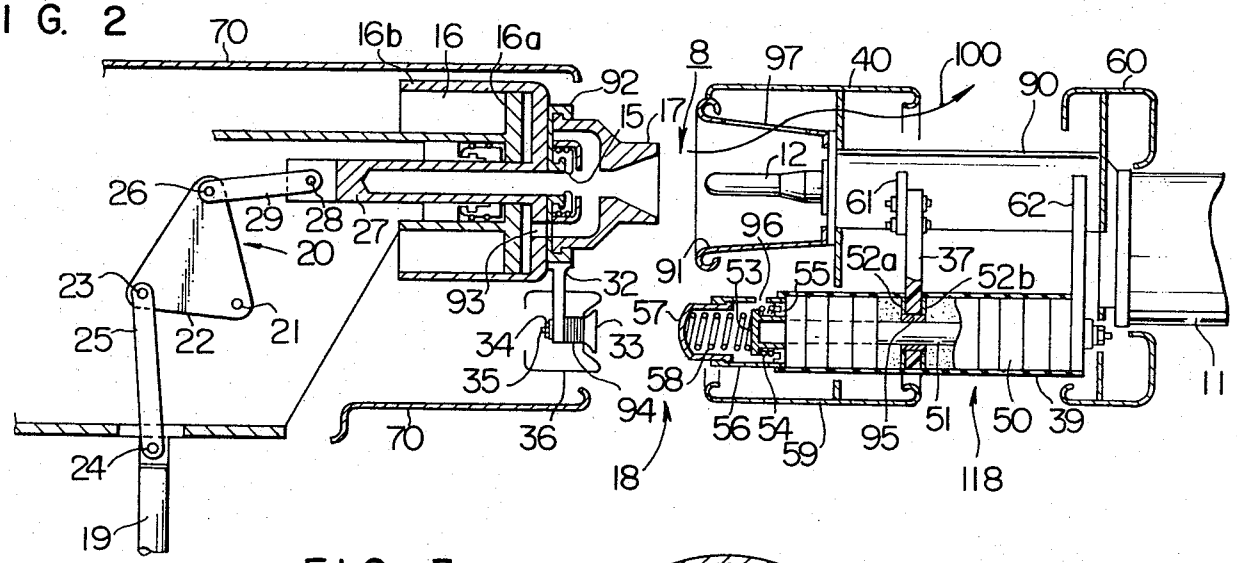
FIG. 2 shows fragmentary sectional view, on large scale, thereof illustrating an interrupter unit and a resistor contact unit.

When the puffer shaft 27 is driven toward the right in FIG. 2, the movable resistor contact 33 touches the fixed resistor contact 57 and the preinsertion resistor contact unit 18 is inserted into a circuit. The, the main movable contact 15 touches the main fixed contact 12 and both ends of the preinsertion resistor contact unit 18 are short-circuited by the interrupting unit 8. By such contact of the interrupting unit, the fixed resistor contact 57 compresses the spring 58 to move toward the right the dash-pot cylinder 56 having a small opening 96.

To open the puffer type gas circuit breaker, the puffer shaft 27 formed integrally with the main movable contact 15 of the interrupting unit is driven toward the left. During this operation, the repulsion of the dash-pot cylinder 56 allows the fixed resistor contact 57 to move toward the left at a speed lower than in the opening operation, so that the resistor contacts 33 and 57 are first separated and then the main contacts 12 and 15 are separated. Thereafter, the resistor contacts 33 and 57 return to the original position shown in FIG. 2. Shielding the main fixed contact 12 and the fixed resistor contact 57 against the metal tank 1 is effected by shielding cylinders 40 and 60. The first shielding cylinder 40 serves to guide the arc suppressing or extinguishing gas ($SF_6$) from the opening 97 in the shield 91 to a direction (100) or opposite direction to the preinsertion resistor contact unit 18. That is, the first shielding cylinder 40 controls the flow of gas. The first shielding cylinder 40 also serves to weaken the electric field in the vicinity of the fixture 61. The first shielding cylinder 40 is fixed to the supporting conductor 90 and the shield 91. The second shielding cylinder 60 serves to weaken the electric field in the vicinity of the fixture 62 and the supporting conductor 11. The second shielding cylinder 60 is fixed to the supporting conductor 90. These first and second half-shielding cylinders 40 and 60 facilitate the connection between the fixture 61 and the insulating arm 37 and between the fixture 62 and the preinsertion resistor contact unit 18. The preinsertion resistor contact unit 18 is normally connected to a circuit and portions near the unit 18 undergo high temperature, but the divided cylinder shields allow heat to be radiated through the spacings between them so as to prevent the temperature in the shields from rising excessively.

Figure 3:
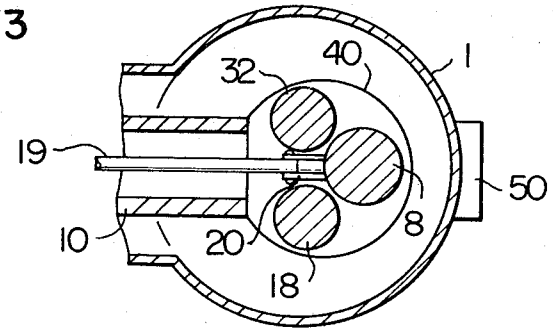
FIG. 3 shows a cross-sectional view of sealed container for containing interrupting units, preinsertion resistor contact units and a capacitor for distributing equal voltage amoung the interrupting units.

FIG. 3 shows a lateral cross-sectional view of a puffer type gas circuit breaker according to one embodiment of the present invention. An interrupting unit 8, a preinsertion resistor contact unit 18 and a voltage distribution capacitor 32 are disposed within a metal tank 1. An insulating operating rod extends from an operating portion (not shown) through a central insulating supporting cylinder 10. According to the present invention, the interrupting unit 8 is located near an opening 50 for maintenance. Accordingly, an operating linkage 20 provided at the end of the insulating operating rod 19 extends through the central insulating supporting cylinder 10 to the interrupting unit 8. The preinsertion resistor contact unit 18 and the capacitor 32 are disposed between the interrupting unit 8 and the central insulating supporting cylinder 10. The interrupting unit 8, the preinsertion resistor contact unit 18 and the capacitor 32 are disposed in a manner that their centers substantially form a triangle. In the embodiment shown in FIG. 3, the set of the interrupting unit 8, the preinsertion resistor contact unit 18 and capacitor 32 is biased toward the opening 50 rather than in the center of the meral tank 1. In FIG. 3, the capacitor 32 is disposed in an upper portion in the metal tank 1 while the preinsertion resistor contact unit 18 is disposed in a lower portion in the metal tank 1. However, the capacitor 32 and the preinsertion resistor contact unit 18 may be disposed in the opposite relation. Although the central insulating supporting cylinder 10 and the insulating operating rod 19 are illustrated such that they can be drawn to the left side of the metal tank 1 as shown in FIG. 3, they may be drawn downwardly from the bottom of the metal tank 1 as shown in FIG. 1.

The arrangement shown in FIG. 3 has the following advantages. The first advantage is that the interrupting unit 8 can be checked and repaired very easily. The interrupting unit 8 is located near the opening 50 and no other devices exist between them. Therefore, the interrupting unit 8 can be easily accessed from the outside of the metal tank 1 through opening the opening 50. Although the preinsertion resistor contact unit 18 and the capacitor 32 are hardly accessible from the opening 50, they are more stable and durable than the interrupting unit 8. Therefore, the inaccessibleness is not regarded as a disadvantage. Since the individual devices shown in FIG. 3 have ground connections in portions near the opening 50, the interrupting unit 8 can be checked and repaired more easily. The easiness of maintenance according to the present invention permits the puffer type gas circuit breaker to be repaired in a relatively short period of time, thus shortening a power failure interval due to troubled circuit breakers.

The second advantage is that the puffer type gas circuit breaker has an increased dielectric strength. The operating linkage 20 for connecting the end of the insulating operating rod 19 to the interrupting unit 8 is located in a position distant from the central insulating supporting cylinder 10. As a result, the central insulating supporting cylinder 10 is subjected to less electric field strength than in the prior art circuit breaker, so that the central insulating supporting cylinder 10 or the metal tank 1 has an improved insulation characteristic. The improved insulation characteristic improves the reliability of the puffer type gas circuit breaker and permits the length of the central insulating supporting cylinder 10 to be reduced, thus permitting the metal tank 1 to be made compact.

The third advantage is that the central insulating supporting cylinder 10 and other insulators are hardly contaminated by the arc or other substances produced when the interrupting unit 8 is operated. Substances resulted from heat due to the arc in response to operation of the circuit breaker deteriorate the dielectric strength of insulators. According to the present invention, such deterioration or adverse effect can be substantially reduced because the interrupting unit 8 and the central insulating supporting cylinder 10 are separated from each other by an adequate distance.

We claim:

1. A puffer type gas circuit breaker including;

an interrupting unit having a main fixed contact, a main movable contact movably disposed in opposed relation with said main fixed contact between a position where it is in contact with and a position where it is separated from said main fixed contact, and a puffer device for compressing and flowing arc-affecting gases across the arc established between the main fixed and movable contacts when the same are separated from each other;

a preinsertion resistor contact unit electrically connected in parallel with the main fixed and movable contacts of the interrupting unit, said preinsertion resistor contact unit having a fixed resistor contact a dash-pot cylinder slidably mounted on the outer surface of said fixed resistor contact for normally biasing said fixed resistor contact toward its closing position, said dash-pot cylinder being of electrically conductive material including a duct for creating the dash-pot effect, a preinsertion resistor assembly electrically connected in series with a dash-pot cylinder and a fixed resistor contact, and a movable resistor contact fixed to said puffer cylinder and adapted to be selectably contacted with said fixed resistor contact;

operating means for actuating said main movable contact and said puffer device; and a sealed container including a grounded tank filled with arc-affecting gas and provided with an opening for maintenance for accommodating said interrupting unit, said preinsertion resistor unit and said operating means; said sealed container, said interrupting unit, said preinsertion resistor contact unit and said operating means being isolated from each other by insulator means; said puffer type gas circuit breaker comprising;

a support arm extending from the outer surface of said puffer cylinder in a direction substantially perpendicular to the axis of said puffer cylinder, and a plurality of adjustment plates disposed along the axis of said main movable contact between said support arm and said movable resistor contact, wherein the number of said adjustment plates are selectively increased or decreased to adjust the time interval between the close of said main fixed and movable contacts and the close of said fixed and movable resistor contacts or the time interval between the open of said main fixed and movable contacts and the open of said fixed and movable resistor contacts.

2. A puffer type gas circuit breaker according to claim 1 further comprising a supporting conductor for fixedly mounting said main fixed contact, said preinsertion resistor assembly comprising a plurality of resistor elements and having one lengthwise end electrically connected to said supporting conductor and another lengthwise end electrically connected to said fixed resistor contact, and an insulating arm one end of which is mounted at a portion between said resistor elements and the other end of which is fixed to said supporting conductor.

3. A puffer type gas circuit breaker according to claim 1 further comprising shield means for shielding said adjustment plates, said movable resistor contact, and the end of said support arm connected to said adjustment plates.

4. A puffer type gas circuit breaker according to claim 2 further comprising;

a first shielding cylinder for enclosing said main fixed contact, said another lengthwise end of said preinsertion resistor assembly, and the fixed portion of said insulating arm, and a second shielding cylinder for enclosing the junction where said preinsertion resistor assembly and said supporting conductor are joined together, wherein said first and second shielding cylinders are located apart from said main fixed contact and mounted fixedly on said supporting conductor.

5. A puffer type gas circuit breaker according to claim 1 further comprising at least two pairs of interrupting units and preinsertion resistor contact units, and a capacitor for distributing equal voltage to said interrupting units, wherein each interrupting unit including the main fixed contact and the main movable contact is located in the vicinity of said opening for maintenance, and interrupting unit, said preinsertion resistor contact unit and said capacitor are disposed in a manner that their centers form a triangle.

* * * * *